United States Patent [19]

Belokin

[11] Patent Number: 4,592,486

[45] Date of Patent: Jun. 3, 1986

[54] HOLDER FOR TOOTHPICKS

[75] Inventor: Martin P. Belokin, Denton, Tex.

[73] Assignee: Martin Paul, Inc., Denton, Tex.

[21] Appl. No.: 648,522

[22] Filed: Sep. 10, 1984

[51] Int. Cl.[4] ..... B65H 1/00

[52] U.S. Cl. ..... 221/283; 221/309; 248/206.5

[58] Field of Search ..... 221/283, 285, 307, 309, 221/310; 248/206.5; 222/181, 185

[56] References Cited

U.S. PATENT DOCUMENTS

| | | | |
|---|---|---|---|
| 102,499 | 5/1870 | Coleman | 221/309 |
| 247,765 | 10/1881 | Keebler | 221/309 |
| 371,621 | 10/1887 | Offrell | 221/309 |
| 409,055 | 8/1889 | Mitchell | 221/309 |
| 575,489 | 1/1897 | Morrow | 221/309 |
| 689,053 | 12/1901 | Anderson et al. | 221/309 |
| 846,683 | 3/1907 | Moore et al. | 221/309 |
| 892,391 | 7/1908 | Blomquist | 221/310 |
| 1,049,788 | 1/1913 | Williams | 221/310 |
| 1,270,301 | 6/1918 | Konsynski | 221/309 |
| 1,785,107 | 12/1930 | Bartholomew | 221/283 |
| 2,170,182 | 8/1939 | Anthony | 222/181 |
| 2,765,959 | 10/1956 | Elliott | 222/181 |
| 3,043,289 | 7/1962 | Fox | 248/206.5 |
| 4,488,653 | 12/1984 | Belokin | 248/206.5 |

*Primary Examiner*—H. Grant Skaggs
*Attorney, Agent, or Firm*—James E. Nilles

[57] ABSTRACT

A holder for toothpicks and the like comprises a one-piece receptacle that is open at its rear and a one-piece retaining member that closes the rear of the receptacle and supports it. The receptacle has an upright front wall from which side walls project rearward, and at its bottom it has forwardly and downwardly inclined upper and lower outlet walls which converge forwardly to have their parallel laterally extending front edges spaced apart vertically by a small distance. The front portion of the lower outlet wall is flatwise flexible so that a toothpick can be drawn out forwardly between those front edges, each outlet wall having a central bay in its front edge for access to the toothpick. Receptacle and retaining member are slidingly connected by laterally outwardly projecting flanges along the rear edges of the receptacle side walls received in channel portions along opposite side edges of the generally flat retaining member. An abutment on the top of the receptacle defines an upper limit of sliding. The retaining member is impregnated with magnetized material to be magnetically adherent to an upright metal support such as a napkin holder.

5 Claims, 5 Drawing Figures

HOLDER FOR TOOTHPICKS

FIELD OF THE INVENTION

This invention relates to a dispensing holder for elongated slender articles such as toothpicks, and the invention is more particularly concerned with a dispensing holder for such articles which comprises only two simple and inexpensive reading assembled parts, which is magnetically securable to an upright supporting surface, and which is so arranged that articles can be readily withdrawn from it one by one.

BACKGROUND OF THE INVENTION

Several prior U.S. patents, some of them very old, disclose dispensing holders for elongated slender articles such as toothpicks and matches, from which such articles can be readily withdrawn one by one without the need for opening a cover or performing any other preparatory operation. See, for example, U.S. Pat. No. 102,499 issued to F. B. Coleman in 1870, No. 247,765 issued to J. Keebler in 1881, No. 371,621 issued to O. Offrell in 1887, No. 409,055 issued to W. B. Mitchell in 1889, No. 575,489 issued to Z. D. Morrow in 1897, No. 689,053, issued to Anderson et al in 1901, and No. 892,391 issued to K. G. Blomquist in 1908.

Each of these prior devices has some distinct and readily apparent disadvantage. Most of them comprise more than two parts, and all of them require relatively complicated, expensive or laborious assembly operations in their manufacture, so that none of them can be considered truly inexpensive. In each case the device is intended to be secured to an upright supporting surface by means of a nail or screw that must be driven into the supporting surface, occasioning some inconvenience for installation and leaving an unsightly blemish when removed.

Other dispensing holders for toothpicks and the like have been arranged to be supported on a horizontal surface such as a counter top, but such holders tend to be more complicated and expensive, especially when they provide for withdrawal of the articles one at a time, and they have the further important disadvantage of occupying working area that may be rather limited.

SUMMARY OF THE INVENTION

The general object of this invention is to provide a dispensing holder for elongated slender articles such as toothpicks which comprises only two simple and inexpensive parts that can be readily assembled in an instant and which is magnetically securable to an upright supporting surface such as a side wall of a metal napkin holder, kitchen range or refrigerator, so as to be capable of instant installation and of instant removal without leaving a trace.

Another and more specific object of the invention is to provide an attractive holder for toothpicks or similar articles which is magnetically attachable to an upright supporting surface and from which the articles can be readily withdrawn one by one, said holder comprising two inexpensive and easily assembled parts, one of them a one-piece receptacle that can be inexpensively molded in plastic with the use of a simple die set, the other a retaining member which simply slides into place on the receptacle and which can be readily produced by extrusion.

It is also a specific object of the invention to provide a dispensing holder of the character described that comprises a one-piece receptacle and a one-piece retaining member, the receptacle being open for filling at its rear, and the retaining member being slidable onto the receptacle to a position in which it supports the receptacle and provides a dust-proof closure for its open rear.

These and other objects of the invention that will appear as the description proceeds are achieved in the holder of this invention, which comprises a one-piece receptacle and a retaining member that is also made in one piece. The receptacle, which is open at its rear, comprises a front wall having an upright upper portion and a lower portion which projects obliquely downward and forward from said upper portion and terminates at a laterally extending front edge remote from said upper portion, a pair of side walls projecting rearward from said front wall and having upright straight and parallel rear edges, and a bottom wall which is downwardly and forwardly inclined but is more nearly horizontal than said bottom portion of the front wall to be forwardly convergent toward it, said bottom wall having a rear portion which is connected with said side walls at their bottoms to be supported by them and a rear edge of which is substantially coplanar with said rear edges of the side walls, having a front edge that is parallel and downwardly adjacent to the first mentioned front edge to cooperate with it in normally confining a slender article in the receptacle, and having a front portion which is detached from the side walls to be flatwise flexible up and down for permitting an article to be drawn forward between said front edges. The receptacle is further characterized by each of said front portion of the bottom wall and said bottom portion of the front wall having a forwardly concave bay in its front edge through which an article confined by said lips is accessible for forward withdrawal, a laterally outwardly projecting elongated flange extending lengthwise along the rear edge of each of the side walls, and means on a top portion of the receptacle defining a downwardly facing abutment adjacent to an upper end of each of said flanges. The retaining member is impregnated with magnetic material and has a flat rear surface to be magnetically securable to a substantially flat upright supporting surface. A rearwardly projecting elongated channel portion extends along each of a pair of opposite side edges of the retaining member, each said channel portion defining an elongated groove which opens laterally towards the other channel portion and wherein one of said flanges is receivable, the channel portions thus being cooperable with the flanges to slidably connect the retaining member to the receptacle. An upper edge portion of the retaining member is engageable against said abutment to define a limit of downward sliding of the receptacle relative to the retaining member at which the latter supports the receptacle and closes its open back.

BRIEF DESCRIPTION OF DRAWINGS

In the accompanying drawings, which illustrate what is now regarded as a preferred embodiment of the invention.

DETAILED DESCRIPTION OF PREFERRED EMBODIMENT OF THE INVENTION

Figure 1:
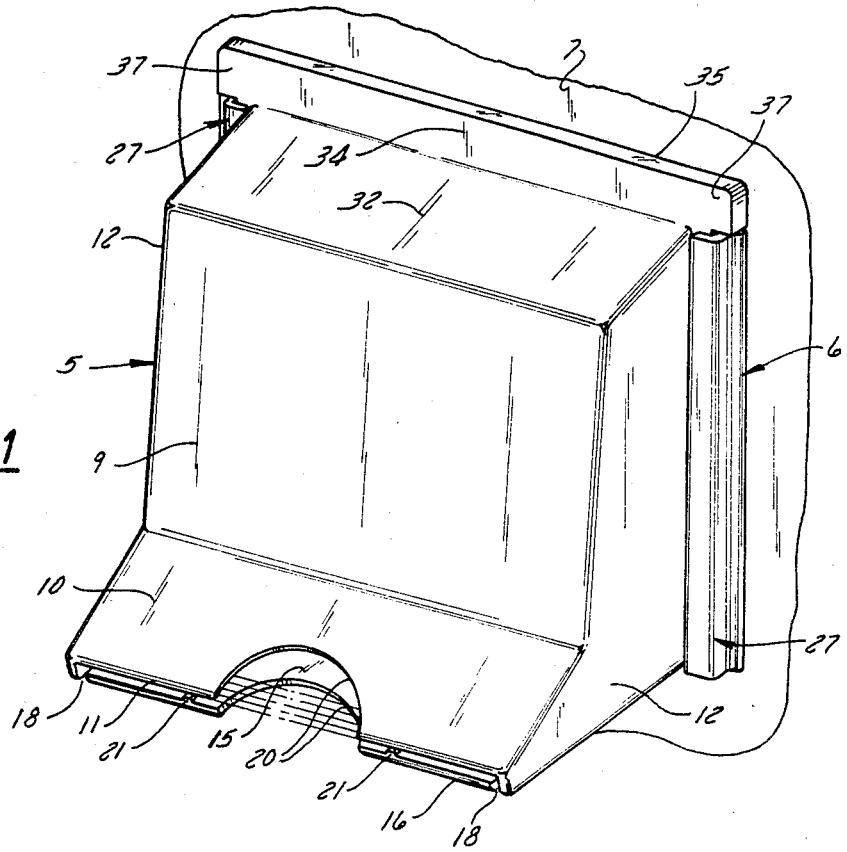
FIG. 1 is a front perspective view of the dispensing holder of this invention.
Figure 2:
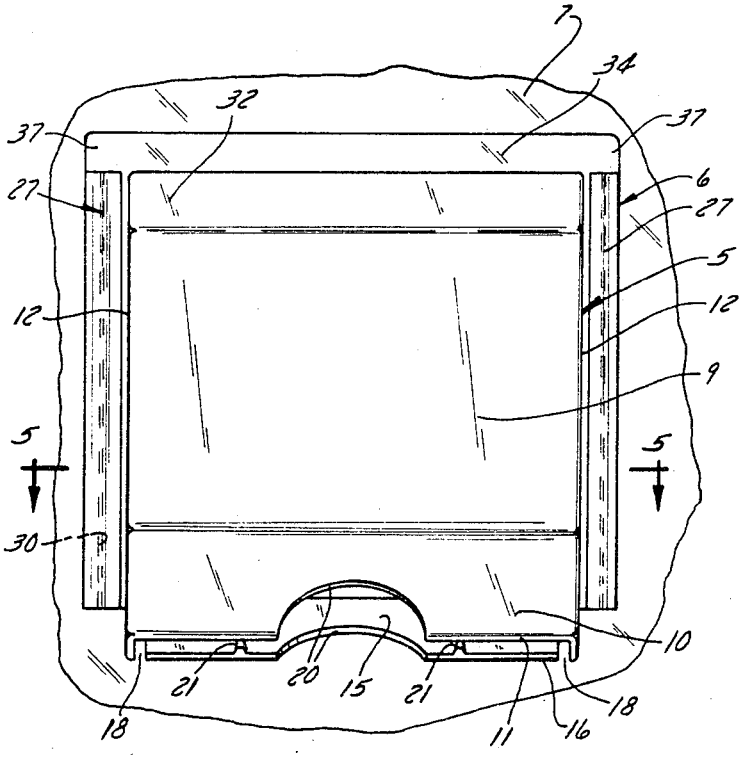
FIG. 2 is a view of the holder in front elevation.
Figure 3:
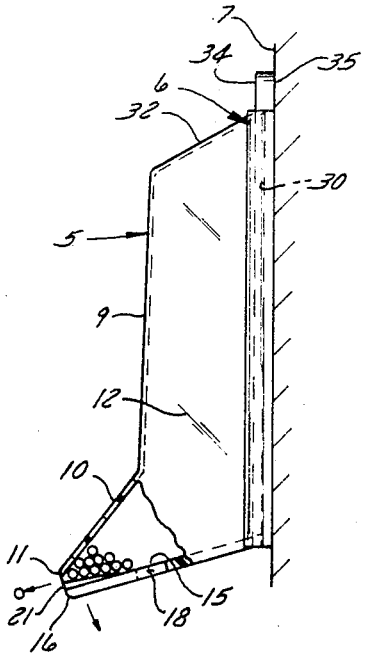
FIG. 3 shows the holder in side elevation with a portion of a side wall broken away.
Figure 4:
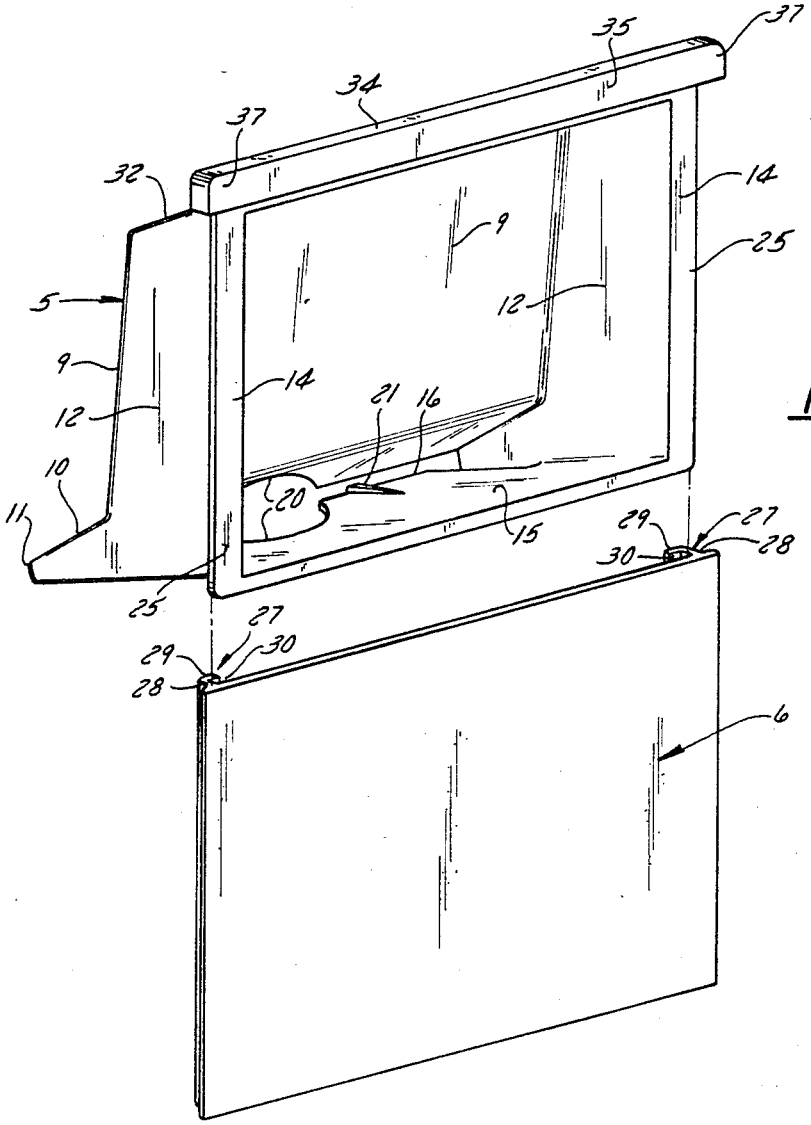
FIG. 4 is a disassembled rear perspective view of the holder.
Figure 5:
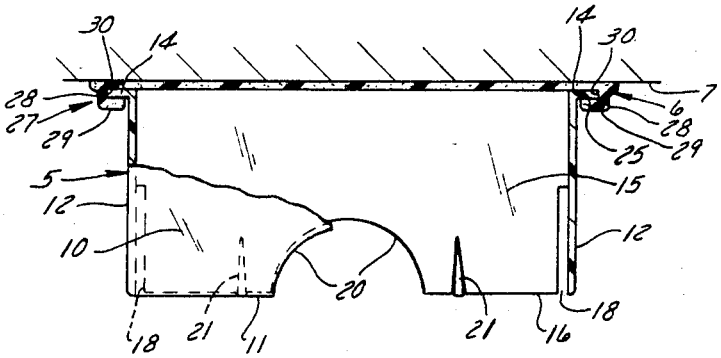
FIG. 5 is a view mainly in horizontal section on the plane of the line 5—5 in FIG. 2, but with a portion of the upper outlet wall shown broken away.

A dispensing holder for toothpicks and similar elongated, slender articles that embodies the principles of this invention comprises a one-piece receptacle 5 that is open at its rear and a one-piece retaining member 6 that can be slidably assembled with the receptacle to close its open rear and to magnetically support the receptacle on an upright magnetically permeable supporting surface 7 such as a side wall of a metal napkin holder.

The receptacle 5 has a front wall with an upright upper portion 9 and a lower portion 10 that extends obliquely forwardly and downwardly from the upper portion to have a laterally extending front edge 11 which is spaced below and in front of the upper portion. The receptacle 5 also has a pair of upright side walls 12 which project rearwardly from the front wall 9, 10 and which have straight and parallel rear edges 14. Connected to the bottoms of the side walls 12 to be supported by them is a bottom wall 15 which is inclined forwardly and downwardly, but which is more nearly horizontal than the lower portion 10 of the front wall to be in forwardly convergent relation to it. Thus, the bottom wall 15 has a laterally extending front edge 16 which is parallel to the front edge 11 of the front wall and downwardly adjacent to it.

It will be seen that the bottom wall 15 and the inclined bottom portion 10 of the front wall comprise upper and lower outlet walls for the receptacle whereby toothpicks or the like in the receptacle are guided to slide or roll to a position just inside the adjacent edges 11, 16 of those outlet walls, in the lowest part of the receptacle. Normally, the adjacent front edges 11, 16 of the outlet walls 10, 15 are spaced apart by a distance less than the thickness of the articles in the container so that they cannot pass those edges. However, the front portion of the bottom wall 15 is detected from the side walls 12, as by narrow, forwardly extending slots 18, one along the bottom edge of each side wall, so that the front portion of the bottom wall is flatwise flexible downward to permit an article to be drawn forward between the front edges. Obviously, similar slots could be provided at the side edges of the upper outlet wall 10, instead of or in addition to the slots 18, so that it could be flexible up and down. To facilitate forward withdrawal of articles from the receptacle, the front edge of each of the outlet walls has an arcuate forwardly concave central bay 20 therein through which a thumb and forefinger can be inserted for grasping the article adjacent to the edges 11, 16 and drawing if forwardly past those edges.

Preferably the upper or inner surface of the lower outlet wall 15 has a pair of short ribs or ridges 21 formed thereon, one at each side of its bay 20, each of which has a front end at the front edge 16 of that wall and tapers rearwardly. With these the spacing between the front edges 11, 16 of the outlet walls need not be held to a close tolerance and toothpicks or the like will nevertheless be securely confined in the holder until withdrawn, even though they vary substantially in thickness.

For slidably connecting the retaining member 6 to the receptacle 5, the latter has an elongated laterally outwardly projecting flange 25 on each of its side walls 12, extending along the rear edge 14 of the side wall and preferably having its rear surface coplanar with that edge. The retaining member 6, which is for the most part plate-like, with flat and parallel front and rear surfaces, and which is rectangular in outline, has a forwardly projecting channel portion 27 extending along each of its side edges, in each of which one of the flanges 25 is lengthwise slidably receivable. Each such channel portion 27 is substantially L-shaped in cross-section, with a forwardly projecting leg 28 and a laterally inwardly projecting leg 29 that overlies the flat front surface of the retaining member, in forwardly spaced relation thereto, to define a slot or groove 30 which opens towards the other channel portion and which is of a width to receive a flange 25.

It will be observed that the retaining member 6 has a horizontal cross-section which is uniform all along its length between its top and bottom edges, and that it is also symmetrical to its vertical centerline; hence it can be readily produced as an inexpensive extrusion that is cut to length. The retaining member is made of an elastomeric plastic that is impregnated with magnetized material, and because of its flat rear surface it is well suited for magnetic attachment to a flat, upright metal supporting surface, to which it clings securely, but from which can be easily removed without leaving a trace.

In addition to its walls described above, the receptacle 5 has a top wall 32 which is in this case shown as forwardly and downwardly inclined, to present a more or less symmetrical appearance in relation to the similarly inclined outlet walls 10, 15. The rear edge of the top wall 32 is coplanar with the rear edges of the side walls 12 and the bottom wall 15, to be closely overlain by the front or inner surface of the retaining member 6.

Extending all across the top wall and the side flanges 25, and projecting a distance beyond each of those flanges, is an upwardly projecting, laterally elongated flange 34. The rear surface 35 of that flange 34 is contained in a plane which is spaced a little to the rear of the plane containing the rear edges of the top, bottom and side walls; hence the bottom edge surface of the flange 34 defines a downwardly facing abutment against which the top edge of the retaining member is engageable. The tab-like projecting end portions 37 of the flange 34 define coplanar downwardly facing abutments which engage the rearwardly projecting legs 28 of the channel portions of the retaining member. Such engagement of the top of the retaining member against the abutments on the receptacle of course establishes the lower limit of sliding of the receptacle relative to the retaining member, at which the retaining member supports the receptacle and closes its open rear.

The receptacle 5 is of course filled through its open rear. It is preferably made of transparent plastic so that its contents are readily seen.

From the foregoing description taken with the accompanying drawings, it will be readily apparent that this invention provides a holder for toothpicks and similar articles from which such articles can be readily removed one at a time, and that the holder of this invention can be very inexpensively made from two simple and easily assembled parts and can be mounted on an upright supporting surface without the use of fasteners or adhesives.

I claim:

1. A holder for elongated slender articles such as toothpicks from which the articles can be removed one by one, said holder being characterized by:

A a one-piece receptacle which is open at its rear and which comprises (1) a front wall having (a) an upright upper portion and (b) a lower portion which projects obliquely downward and forward from said upper portion and terminates at a laterally extending front edge remote from said upper portion, (2) a pair of side walls projecting rearward from said front wall and having upright straight and parallel rear edges, and (3) a bottom wall which is downwardly and forwardly inclined but is forwardly convergent toward said bottom portion of the front wall, said bottom wall (a) having a rear portion which is connected with said side walls at their bottoms to be supported by them and a rear edge of which is substantially coplanar with said rear edges of the side walls, (b) having a front edge that is parallel and downwardly adjacent to the first mentioned front edge to cooperate with it in normally confining a slender article in the receptacle, (c) having a front portion which is detached from the side walls to be flatwise flexible for permitting an article to be drawn forward between said front edges;

B. said receptacle being further characterized by (1) each of said front portion of the bottom wall and said bottom portion of the front wall having a forwardly concave bay in its front edge through which an article confined behind said front edges is accessible for forward withdrawal, (2) a laterally outwardly projecting elongated flange extending lengthwise along the rear edge of each of the side walls, and (3) means on a top portion of the receptacle defining a downwardly facing abutment; and C. a one-piece retaining member for supporting the receptacle, said retaining member (1) being impregnated with magnetic material, (2) having a flat rear surface to be magnetically secured to a substantially flat upright supporting surface, (3) having a rearwardly projecting elongated channel portion extending along each of a pair of opposite side edges thereof, each said channel portion defining an elongated groove which opens laterally towards the other channel portion and wherein one of said flanges is receivable, said channel portions being cooperable with said flanges to slidably connect the retaining member to the receptacle, and (4) being engageable against said abutment to define a limit of downward sliding of the receptacle relative to the retaining member at which the latter closes the open back of the receptacle.

2. A holder for elongated slender articles such as toothpicks from which the articles can be removed one by one, said holder being characterized by:

A. A one-piece receptacle which is open at its rear and which comprises (1) an upright front wall, (2) opposite side walls projecting rearward from said front wall and having upright straight and parallel rear edges, each said side wall having an elongated laterally outwardly projecting flange extending lengthwise along its rear edge, (3) means on a top portion of the receptacle defining a downwardly facing abutment adjacent to an upper end of each of said flanges, and (4) upper and lower forwardly and downwardly inclined outlet walls, each having a laterally extending front edge which is parallel and vertically adjacent to the front edge of the other and which is spaced forwardly from the plane of said front wall, (a) the upper outlet wall being connected with the bottom of said front wall, (b) the lower outlet wall being connected with said side walls and supported by them and having a rear edge which is substantially coplanar with the rear edges of the side walls, (c) one of said outlet walls having at least a front portion which is detached from the side walls to be flatwise flexible up and down so that said outlet walls normally cooperate to confine a slender article in the receptacle but allow it to be withdrawn forwardly between their front edges, and (d) each said outlet wall having a forwardly concave bay in its front edge through which an article between the outlet walls is accessible for forward withdrawal; and B. a one-piece retaining member (1) having a substantially flat body portion with opposite side edges and opposite top and bottom edges, said body portion being impregnated with magnetic material to be magnetically securable to an upright magnetically permeable supporting surface, and (2) having elongated rearwardly projecting channel portions extending lengthwise along opposite side edges of its body portion, each defining a groove that opens laterally towards the other channel portion, said channel portions being cooperable with said flanges to connect the receptacle and the retaining member for vertical sliding to and from a position in which said upper edge of the retaining member engages said abutment and at which the retaining member closes the open rear of the receptacle and can support the receptacle.

3. The holder of claim 2, wherein said receptacle is further characterized by:

(1) a top wall projecting rearward from said front wall and having a rear edge substantially coplanar with the rear edges of the side walls and the lower outlet wall, and (2) said means on the top portion of the receptacle comprising an upwardly projecting laterally elongated flange on said top wall, having a rear surface in rearwardly offset relation to the plane containing said rear edges and having a bottom edge surface which defines said abutment and which is engageable by said top edge.

4. The holder of claim 3 wherein said flange on the top wall has end portions which project sidewardly beyond the first mentioned flanges and which define further abutments that are engaged by the upper ends of said channel portions.

5. The holder of claim 2 wherein the lower outlet wall has its front portion detached from the side walls to be flexible up and down, further characterized by a pair of upwardly projecting elongated ribs on the upper surface of said lower outlet wall, one at each side of said bay, each having a maximum height at the front edge of that wall and tapering in height rearwardly therefrom.

* * * * *